United States Patent [19]

Hildebrand

[11] Patent Number: 4,546,941

[45] Date of Patent: Oct. 15, 1985

[54] FOLDABLE SUPPORT STRUCTURE OF CARDBOARD, PLASTIC AND THE LIKE

[76] Inventor: James R. Hildebrand, 4102 E. 7th St., P.O. Box 4830, Long Beach, Calif. 90804

[21] Appl. No.: 589,019

[22] Filed: Mar. 13, 1984

[51] Int. Cl.[4] ..... A45D 19/04

[52] U.S. Cl. ..... 248/174; 108/153; 297/442; 312/259

[58] Field of Search ..... 248/152, 174, 165; 5/DIG. 1; 312/259; 108/150, 153; 297/442

[56] References Cited

U.S. PATENT DOCUMENTS

| | | | |
|---|---|---|---|
| 1,962,833 | 6/1934 | Nuckols | 248/174 |
| 2,361,875 | 10/1944 | Sachs | 108/150 X |
| 2,537,318 | 1/1951 | Scoble | 248/174 X |
| 2,550,959 | 5/1951 | Bowman | 248/174 X |
| 3,174,675 | 3/1965 | Rosenburg, Jr. | 5/DIG. 1 |
| 3,460,790 | 8/1969 | Baird | 297/442 X |
| 3,566,808 | 3/1971 | Slate, Jr. | 297/442 X |
| 3,724,399 | 4/1973 | Notko et al. | 108/150 X |
| 4,078,502 | 3/1978 | Barna | 248/174 X |
| 4,333,622 | 6/1982 | Albano | 248/174 X |

FOREIGN PATENT DOCUMENTS

| | | | |
|---|---|---|---|
| 1296657 | 2/1962 | France | 248/174 |

*Primary Examiner*—J. Franklin Foss
*Assistant Examiner*—David L. Talbott

[57] ABSTRACT

A two-component, interlocking foldable seat or support of cardboard, and the like, is provided from foldable blanks. Each component is folded into a closed, multi-sided shape and lightly locked together along its peripheral edges. Seating panels on each component extend from a rear sidewall, and are slotted to enable folding and engagement along corresponding slots of opposed sides.

The two components are interfitted along slots that are aligned with the seating panel slots. The seating panels are then folded and engaged along their respective slots to produce a stable platform.

4 Claims, 8 Drawing Figures

FOLDABLE SUPPORT STRUCTURE OF CARDBOARD, PLASTIC AND THE LIKE

BACKGROUND OF THE INVENTION

This invention relates to a new and improved foldable seat of cardboard, and the like. More specifically, this invention relates to a foldable seat comprising two interlocking components that produce a stable seating platform.

Previously designed seating platforms of cardboard have been of the single, foldable type. Consequently, when seating pressure force is applied, the entire structure behaves as a single unit. When used on an uneven surface, these foldable seats tend to rock. Preferably, cardboard seating platforms should have sufficient structural integrity to support a heavy load, e.g. about 300 pounds, but at the same time have sufficient flexibility to reduce localized distortion, and distribute seating forces uniformly therethrough.

THE INVENTION

According to the invention, there is provided a two-component, folded cardboard support, such as a seat, each component comprising a foldable, multi-panel blank that is fastened or lightly interlocked along the outside edges. Seating panels on each component extend from a rear side wall and are slotted to engage corresponding slots of opposed or inclined sidewalls. The two components are interfitted along slots that are aligned with the seating panel slots. The seating panels are then folded into and engaged along their respective slots to produce a stable seating platform.

When seating pressure is applied, the entire structure will deform somewhat, both along the bottom edges, and internally, since the cardboard is flexible. Hence, the seat will conform to an uneven surface, and evenly distribute load forces such as twisting movements and oblique pressures. The support structure of this invention enables use of stamped blanks of cardboard, waxed or plastic coated cardboard, plastic, etc. If desired, following use, the structures can be unfolded and stacked into a flat pile for efficient storage and transportation.

DESCRIPTION OF THE PREFERRED EMBODIMENTS

Figure 1:
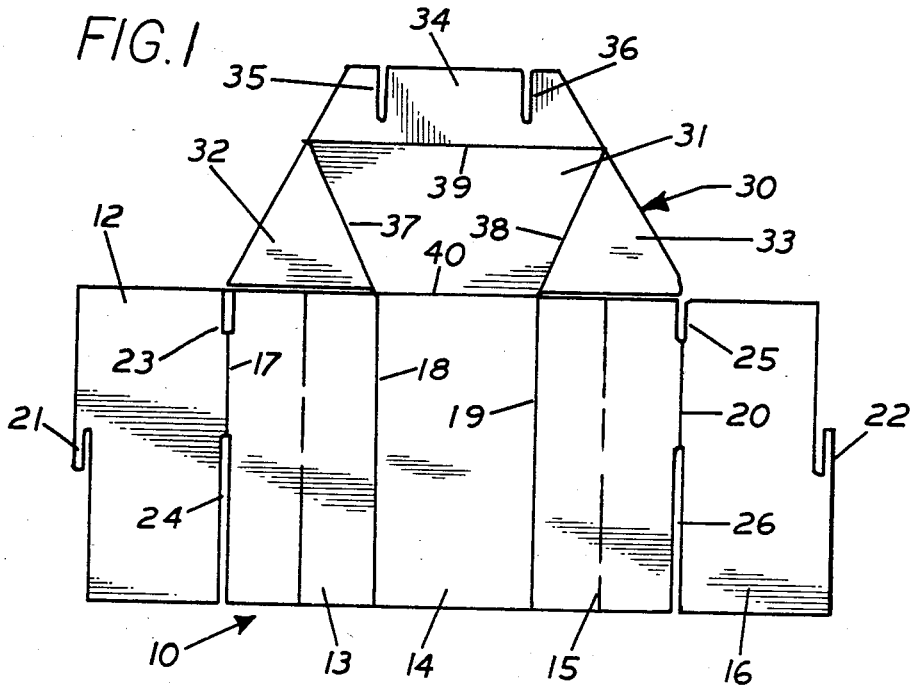
FIGS. 1 and 2 are plan views of the stamped blank sheets that form the dual component halves of the support structure.
Figure 2:
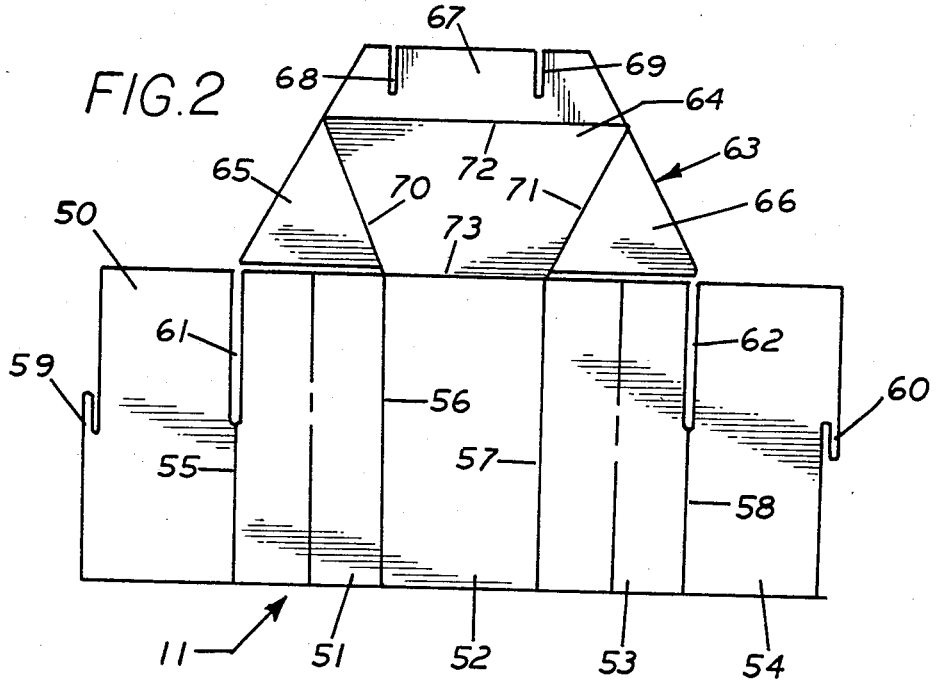

The two interlocking components 10, 11 that form the support structure of this invention, are shown in FIGS. 1 and 2 as blank cut-outs. In FIG. 1, the cut-out includes panels 12, 13, 14, 15 and 16; these cut-outs can be folded inwardly along fold lines 17, 18, 19 and 20. Preferably, minor fold lines (dotted designation) should also be employed. Interlock tabs, or other locking means 21, 22 are formed or attached along the outer edges of the panels 12 and 16, respectively. Interlock slots 23 and 24, 25 and 26 are formed along respective fold lines 17 and 20. The top portion 30 of the blank functions as one half portion of a seat, or other support. The top portion 30 provides a center panel 31, outer support panels 22, 33 whose use is optional, depending on panel strength, and an interlock panel 34 having interlock slots 35, 36. The support panels 32, 33 and interlock panel 34 are inwardly foldable along fold lines 37, 38 and 39. The center panel 31 folds downwardly along fold line 40.

The interlocking component 11 shown in FIG. 2 is basically the same as the component 10 of FIG. 1, except that the corresponding interlock tabs and slots of both components are reversed opposed to each other. The interlocking component 11 includes panels 50, 51, 52, 53 and 54 that can be folded inwardly along fold lines 55, 56, 57 and 58; preferably, minor fold lines (dotted designation) should be employed. Interlock tabs 59, 60 are formed along the outer edges of the panels 50 and 54, respectively. Interlock slots 61, 62 are formed along the respective fold lines 55 and 58. The top portion 63 of the blank 11 functions as the other half of the seat of the structure.

The top portion 63 provides a center panel 64, outer support panels 65, 66, whose use is optional, and an interlock panel 67 having interlock slots 68, 69. The support panels 65, 66 and interlock panel 67 are inwardly foldable along fold lines 70, 71 and 72. The center panel 64 folds downwardly along fold line 73.

Figure 3:
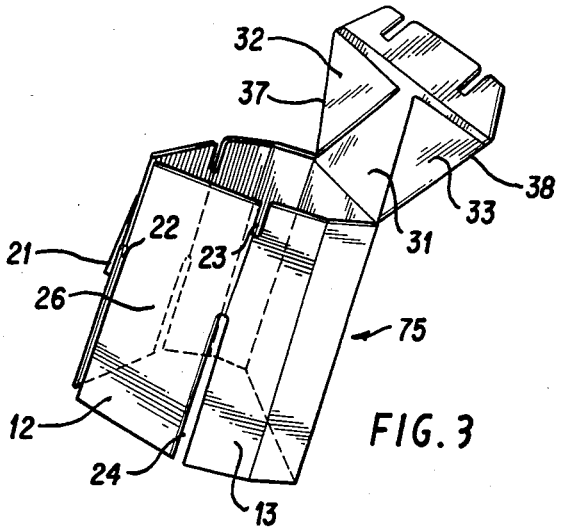
FIGS. 3 and 4 are external perspective views showing the initially folded component halves corresponding respectively to FIGS. 1 and 2.
Figure 4:
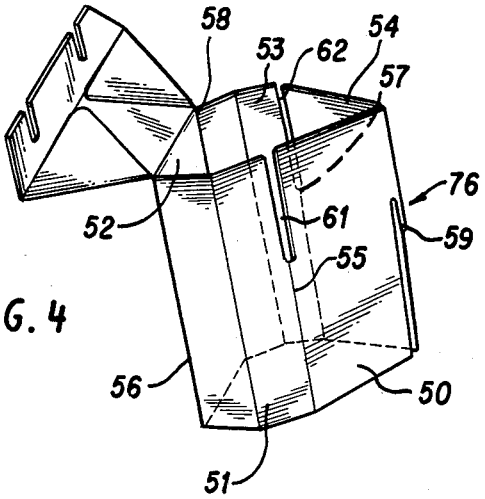

The structure is assembled by initially folding panel 10 inwardly and interlocking the tabs 21 and 22 to form the preliminary structure 75 shown in FIG. 3. Similarly, component 11 is folded inwardly, and the tabs 59, 60 are interlocked to form the preliminary structure 76 shown in FIG. 4.

Figure 5:
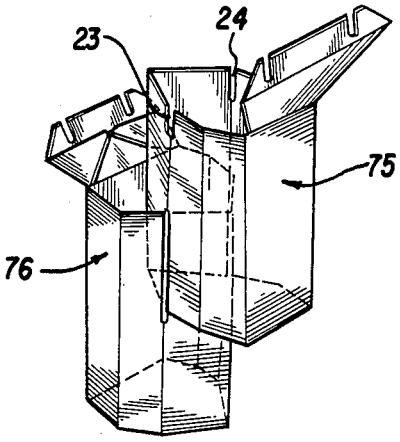
FIG. 5 is an external perspective view showing the initial interlocking of the folded component halves to partially assemble the components of FIGS. 3 and 4.

The preliminary structures 75, 76 are then initially interlocked along corresponding slots 24, 61 and 26, 62; this initial interlock between the two structures is shown in FIG. 5.

Figure 6:
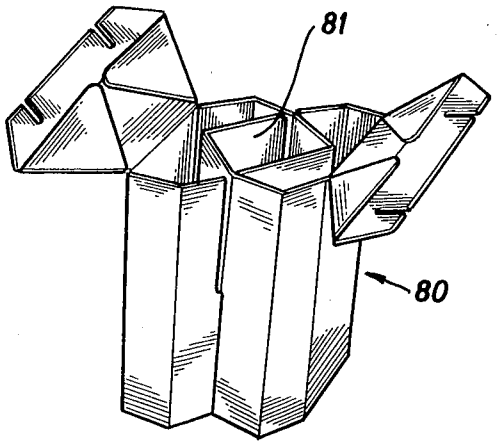
FIG. 6 is an external perspective view showing the complete interlocking of the component halves with the seat panels being unfolded.

The initial interlock between the two structures 75, 76 shown in FIG. 5 is then completed, by sliding these two structures together to form the final, interlocked structure 80, as shown in FIG. 6. The slots 23, 24 and 61 are fairly colinear, and slots 25, 26 and 62 are similarly colinear. The interior of the structure 80 forms an inner square or rectangular shape 81 due to overlapping of the interlocking structures 75, 76. The size of the cylindrical shape 81 can be controlled by appropriate sizing of the various panels.

Figure 7:
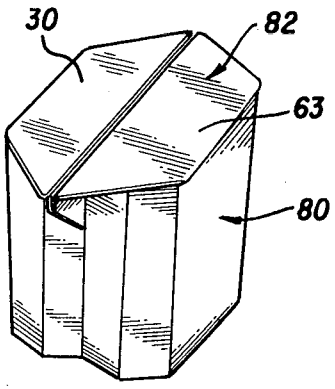
FIG. 7 is an external perspective view of the completely assembled support structure of this invention; and, FIG. 8 is an external perspective view of another form of support structure according to the invention.

Finally, the interlocked structure is completely assembled as shown in FIG. 7, by sequentially inwardly folding support panels 32, 33, downwardly folding the top portion 30 along fold line 40, and folding interlock panel 34 downwardly so that the slots 35, 36 interlock with corresponding slots 23, 25 respectively. Similarly, the top portion 63 of structure 76 is interfitted into the structure 80, the interlock slots 68, 69 interlocking with corresponding slots 23, 25 and 61, 62 respectively. The two interlock panels 34 and 67 contact each other, and due to the outward biasing of each panel, and the frictional contact between them, these panels wil remain in place. Consequently, the top portions 30, 63 will remain in static equilibrium and form a flat, stable support surface 82.

Furthermore, the outer perimeter of the structure 80, and the inner cylinder 81 form a stable support having good load bearing capability. If desired, adjacent panels of the structure may be secured with tape, corner brackets, glue, staples, fasteners, etc., to impart additional reinforcement, and improve the load bearing capability.

Figure 8:
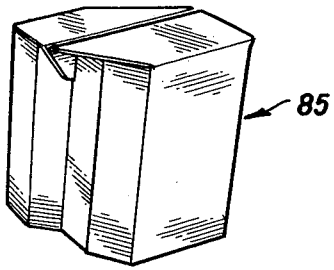

The structure 85 shown in FIG. 8 has a four-sided perimeter by employing fewer fold lines than the blanks shown in FIGS. 1 and 2; however, the basis interlocking operation will remain unchanged.

I claim:

1. A two-component, interlocked support structure, each component formed from a cut-out blank of cardboard, and the like, each component comprising:

A. a panel array, each array defining two outer panels, two respective adjacent inner panels, and a center panel adjacent to the respective inner panels, the corresponding panels in the array being of equal size;

B. fold lines defined between adjacent panels for folding movement of panels therealong, each inner panel defining a fold line medially thereof;

C. opposed, interlocking means provided along outer edges of the outer panels;

D. interlock slots defined along fold lines of the panels, the slots of each component being reverse opposed to each other;

E. a support cover panel extending from the center panel and joined thereto along a fold line;

F. interlock slots defined from a panel edge and along a fold line between the outer panel and an adjacent inner panel of one of said components; and, G. a foldable interlock cover panel provided forwardly of the cover panel, the interlock panel defining a plurality of interlock slots; the support structure being formed by the steps of:

(a) folding each component blank to interlock adjacent edges with the interlocking means to form two preliminary, five-sided congruent structures;

(b) interlocking both preliminary structures along their respective reverse opposed slots, thereby forming: i. an internal, cylindrical structure defined by the said interlocked adjacent edges of each interlocked component; and, ii. an external perimeter structure defined by the remaining portion of the panels, the center panels being positioned in opposed relationship on the said perimeter, and respective corresponding inner panels of each array being oriented outwardly in opposed relationship on the perimeter of the structure to form adjacent outwardly folded walls, and thereby produce a ten-sided perimeter;

(c) inserting each of said cover panels along its slots to interlock with the said interlock edge slots and into opposed registry, to form: i. a closed upper cover supported by the internal cylindrical structure and external perimeter structure; and, ii. an open-ended bottom structure; each of said cover panels being outwardly biased, and in frictional contact with each other; thereby producing a static equilibrium therebetween, and forming a flat, stable, upper support for a downward load on the said cover, the support structure being adapted to deform, and distribute load forces therethrough, including twisting movements and oblique forces, the structure being adapted for unlocking and unfolding to form the respective cut-out blanks.

2. The support structure of claim 1, in which reinforcing panels are attached to the respective support panels.

3. The support structure of claim 1, in which the cylindrical structure has a square cross section.

4. The support structure of claim 1, in which the cylindrical structure defines a rectangular cross section.

* * * * *